US007793431B2

(12) United States Patent
Yu

(10) Patent No.: US 7,793,431 B2
(45) Date of Patent: Sep. 14, 2010

(54) ENERGY RECYCLING FOOTWEAR

(75) Inventor: Chun Ho Yu, Hong Kong (HK)

(73) Assignee: Yue's Hong Kong Invention Limited, Hong Kong (CN)

( * ) Notice: Subject to any disclaimer, the term of this patent is extended or adjusted under 35 U.S.C. 154(b) by 887 days.

(21) Appl. No.: 11/672,498

(22) Filed: Feb. 7, 2007

(65) Prior Publication Data

US 2008/0184596 A1 Aug. 7, 2008

(51) Int. Cl.
*A43B 13/28* (2006.01)

(52) U.S. Cl. ..... 36/27; 36/38; 36/37

(58) Field of Classification Search ..... 36/27, 36/28, 38, 7.8, 35 R, 37
See application file for complete search history.

(56) References Cited

U.S. PATENT DOCUMENTS

| | | | | | |
|---|---|---|---|---|---|
| 507,490 | A * | 10/1893 | Gambino | 36/3 B |
| 819,449 | A * | 5/1906 | Otterstedt | 36/3 B |
| 904,891 | A * | 11/1908 | Otterstedt | 36/3 B |
| 1,088,328 | A * | 2/1914 | Cucinotta | 36/28 |
| 2,668,374 | A * | 2/1954 | Seigle | 36/28 |
| 2,669,038 | A * | 2/1954 | De Werth | 36/38 |
| 3,388,485 | A * | 6/1968 | Pierce | 36/7.8 |
| 4,030,213 | A * | 6/1977 | Daswick | 36/30 R |
| 4,296,557 | A * | 10/1981 | Pajevic | 36/7.8 |
| 4,322,893 | A * | 4/1982 | Halvorsen | 36/43 |
| 4,457,084 | A * | 7/1984 | Horibata et al. | 36/7.8 |
| 4,910,884 | A | 3/1990 | Lindh et al. | |
| 5,845,419 | A | 12/1998 | Begg | |
| 6,393,731 | B1 | 5/2002 | Moua et al. | |
| 6,718,655 | B2 * | 4/2004 | Sugawara | 36/28 |
| 6,751,891 | B2 * | 6/2004 | Lombardino | 36/28 |
| 6,751,981 | B1 | 6/2004 | Burnette | |
| 6,996,922 | B2 * | 2/2006 | Ryoo | 36/7.8 |
| 7,600,330 | B2 * | 10/2009 | Chen | 36/27 |
| 2002/0073579 | A1 | 6/2002 | Lombardino | |
| 2003/0126760 | A1 | 7/2003 | Levert et al. | |
| 2003/0217483 | A1 * | 11/2003 | Abraham | 36/28 |
| 2004/0154191 | A1 * | 8/2004 | Park | 36/28 |
| 2005/0204584 | A1 * | 9/2005 | Ryoo | 36/27 |
| 2005/0241184 | A1 | 11/2005 | Levert et al. | |
| 2006/0137217 | A1 * | 6/2006 | Asmundson | 36/7.8 |
| 2008/0184596 | A1 * | 8/2008 | Yu | 36/88 |
| 2008/0216348 | A1 * | 9/2008 | Kwon et al. | 36/27 |

FOREIGN PATENT DOCUMENTS

| | | | |
|---|---|---|---|
| CH | 570130 | A5 | 12/1975 |
| CH | 585531 | A5 | 3/1977 |
| CN | 2187893 | Y | 1/1995 |

(Continued)

*Primary Examiner*—Marie Patterson
(74) *Attorney, Agent, or Firm*—McNeely & Hare LLP; Kevin J. McNeely

(57) ABSTRACT

Footwear including a foot support member and a sole assembly, the sole assembly having a first end and a second end, comprising a plurality of separate insole segments attached to the foot support member for bending the sole assembly, an outsole portion forming the base of the sole assembly, and a plurality of springs engaged between the insole segments and the outsole portion. The springs are arranged in a continuous series across the sole assembly from the first end to the second end, such that the springs exert a constant rebounding force on and across the sole of a user in series throughout a pace cycle.

20 Claims, 7 Drawing Sheets

FOREIGN PATENT DOCUMENTS

| | | | |
|---|---|---|---|
| CN | 2365922 | Y | 3/2000 |
| CN | 2498867 | Y | 7/2002 |
| DE | 3940522 | A1 | 6/1991 |
| DE | 29813203 | U1 | 12/1998 |
| DE | 20211698 | U1 | 1/2003 |
| DE | 20312215 | U1 | 12/2003 |
| DE | 102006005414 | A1 | 8/2006 |
| WO | WO-98/42221 | A1 | 10/1998 |
| WO | WO-00/65943 | A1 | 11/2000 |
| WO | WO-03018141 | A2 | 3/2003 |

* cited by examiner

ENERGY RECYCLING FOOTWEAR

TECHNICAL FIELD

The present invention relates generally to footwear and, in particular, footwear for absorbing shock and returning energy to the user when walking or running.

BACKGROUND

There is existing footwear which consists of a foam heel or an air bag for absorbing shock. However, such design fails to utilize the energy from the foot and much energy is lost during the impact between the sole of the shoe and the ground.

U.S. Pat. No. 5,845,419 discloses footwear which includes a spring device. Such arrangement of the spring device causes discomfort to the user as the spring device limits the flexibility in bending the sole of the shoe. It is also difficult for the user to maintain proper balance with the springs engaged below the sole of the shoe only at the front and back position.

As the shoe sole will be bent by the user in action, the weight of the springs will make it uneasy for the user to bend the shoe sole. The user also has to apply extra force on the shoe sole to return it to the original flat position after bending. The user will find it quite uncomfortable in bending the shoe sole and returning it to the flat position when walking or running.

U.S. Pat. No. 6,751,981 discloses footwear which returns energy to the user. However, the spring device is engaged only on parts of the shoe, for example at the heel portion and the ball portion of the shoe. Much energy is lost during the impact of the other portions of the sole with the ground, for example at the toe area, which is not effectively transferred back to the user. This footwear fails to transmit energy continuously from the backward sole area to the forward sole area in a pace cycle. Much energy is lost and is not captured and rebound to the user.

SUMMARY OF THE INVENTION

The object of the present invention is to provide footwear which transmits energy continuously along the length of the sole area, throughout the beginning to the end of a pace cycle, so that energy from the user applied on the ground in a pace cycle is captured and rebound to the user without much loss.

The footwear of this invention contains separate insole segments to facilitate the bending of the sole assembly, and a set of springs attached to the bottom of the insole segments. The springs are arranged in a continuous series across the whole sole assembly from one end to another, such that the springs exert a constant rebounding force on and across the sole of a user from the back sole area to the forward sole area in series throughout a pace cycle.

Preferably, the springs are arranged evenly across the whole sole assembly to help the user maintain proper balance.

Preferably, a spring device is engaged between two adjacent insole segments for returning the insole segments from a bent position to the original position.

Alternatively, the springs are in conically-tapered shape.

In an embodiment of this invention, the outsole portion is laterally wider than the insole segments, such that the likelihood of lateral tilting of the footwear in use due to the operation of the springs is reduced.

In another embodiment of this invention, the spring disposed at the heel portion is axially tilted backward to maximize the energy transferred from the spring to the user at the beginning of a pace cycle.

In another embodiment, the outsole portion is slightly curved upward along the lateral width toward the edge at the heel portion and the spring disposed at the heel portion is axially tilted laterally toward the edge to conform with the shape of the outsole portion such that the weight of the user is transmitted laterally toward the edge of the outsole portion to stabilize the user when the footwear is in a flat position.

In another embodiment, the outsole portion is slightly curved upward along the lateral width toward the edge at the ball portion and the spring disposed at the ball portion is axially tilted laterally toward the edge to conform with the shape of the outsole portion such that the weight of the user is transmitted laterally toward the edge of the outsole portion to stabilize the user when the footwear is in a flat position.

Yet in another embodiment, the spring disposed at the toe portion is axially tilted forward, such that an upward force is exerted by the release of the spring at the end of a pace cycle to push the user forward.

The footwear of this invention stores the energy resulting from the weight of the user and the force from the foot. The footwear then returns the energy to the user by giving a constant rebounding force against the foot. The impact energy is thus transferred into a force to assist the user in raising the foot. The force serves to push the foot upward when the user is jumping and to move the user forward when the user is walking or running.

The footwear of this invention has an even arrangement of multiple compression springs below the sole in a continuous series, such that, in every pace cycle, the springs shift the weight of the user from the heel, across the sole, and to the ball and toes, and gives a constant push at each corresponding area of the foot. The even arrangement of the springs also assists the user in maintaining proper balance on the footwear.

BRIEF DESCRIPTION OF DRAWINGS

The above and other aspects, features, and advantages of the present invention will become more apparent upon consideration of the following detailed description of preferred embodiments, taken in conjunction with the accompanying drawing figures, wherein:—

DETAILED DESCRIPTION OF PREFERRED EMBODIMENT

Figure 1:
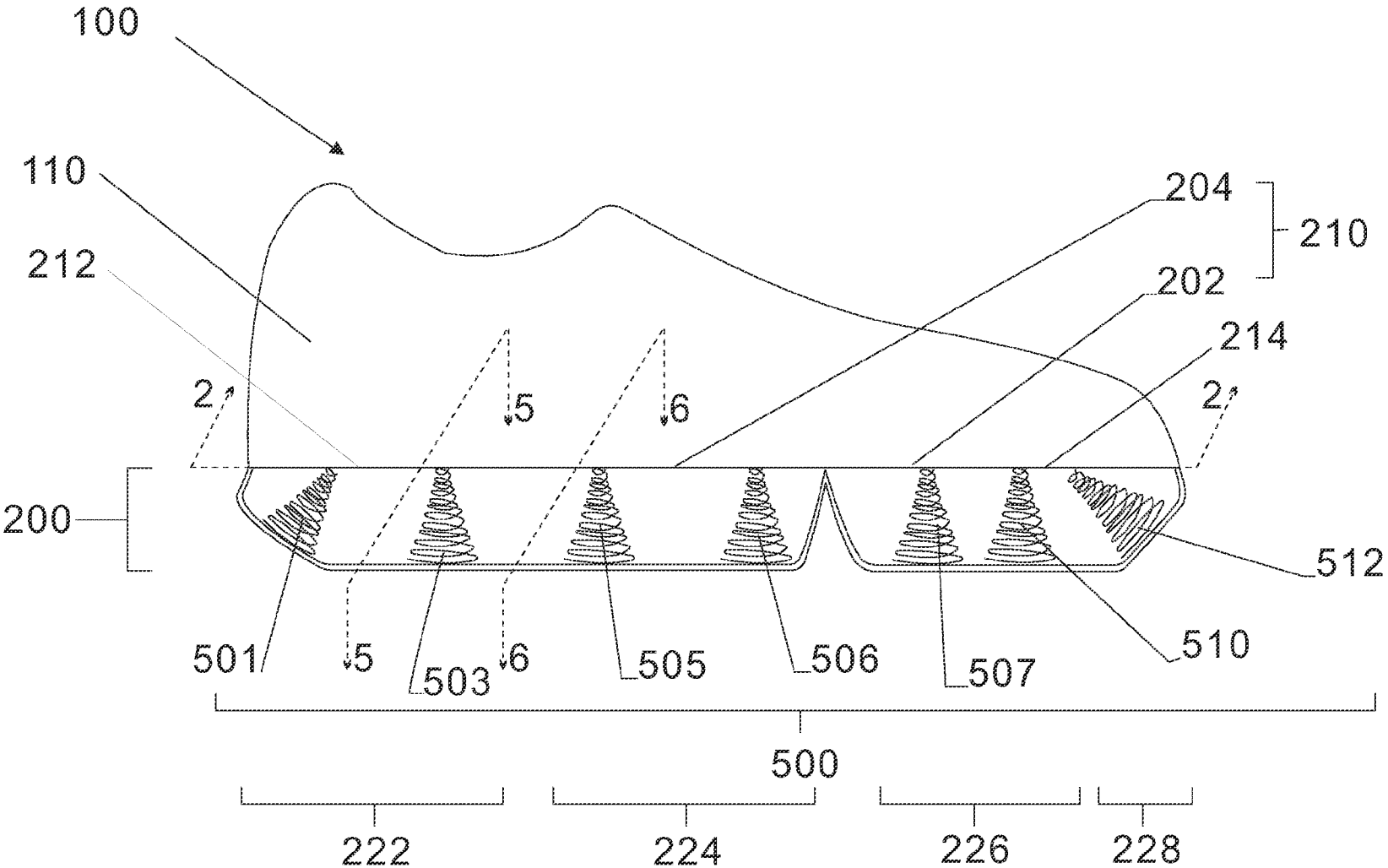
FIG. 1 is a sectional view of footwear according to an embodiment of this invention.

As illustrated in FIG. 1, footwear [100] includes a foot support member [110] and a sole assembly [200]. The foot support member [110] may be a shoe upper made for a typical walking or running shoe, including the conventional parts of vamp, tongue and the eyestay and lacing section (not shown), cemented to the sole assembly [200].

The sole assembly [200] includes an insole section [210] divided into a number of insole segments. By way of example, the insole section [210] has two separate insole segments, a front insole segment [202] at the ball and toe area and a back insole segment [204] at the arch and heel area. The separate insole segments [202, 204] allow the user to readily bend the insole section [210]. The insole section [210] may be divided into more segments to increase the flexibility of the insole section [210] for bending.

Figure 2:
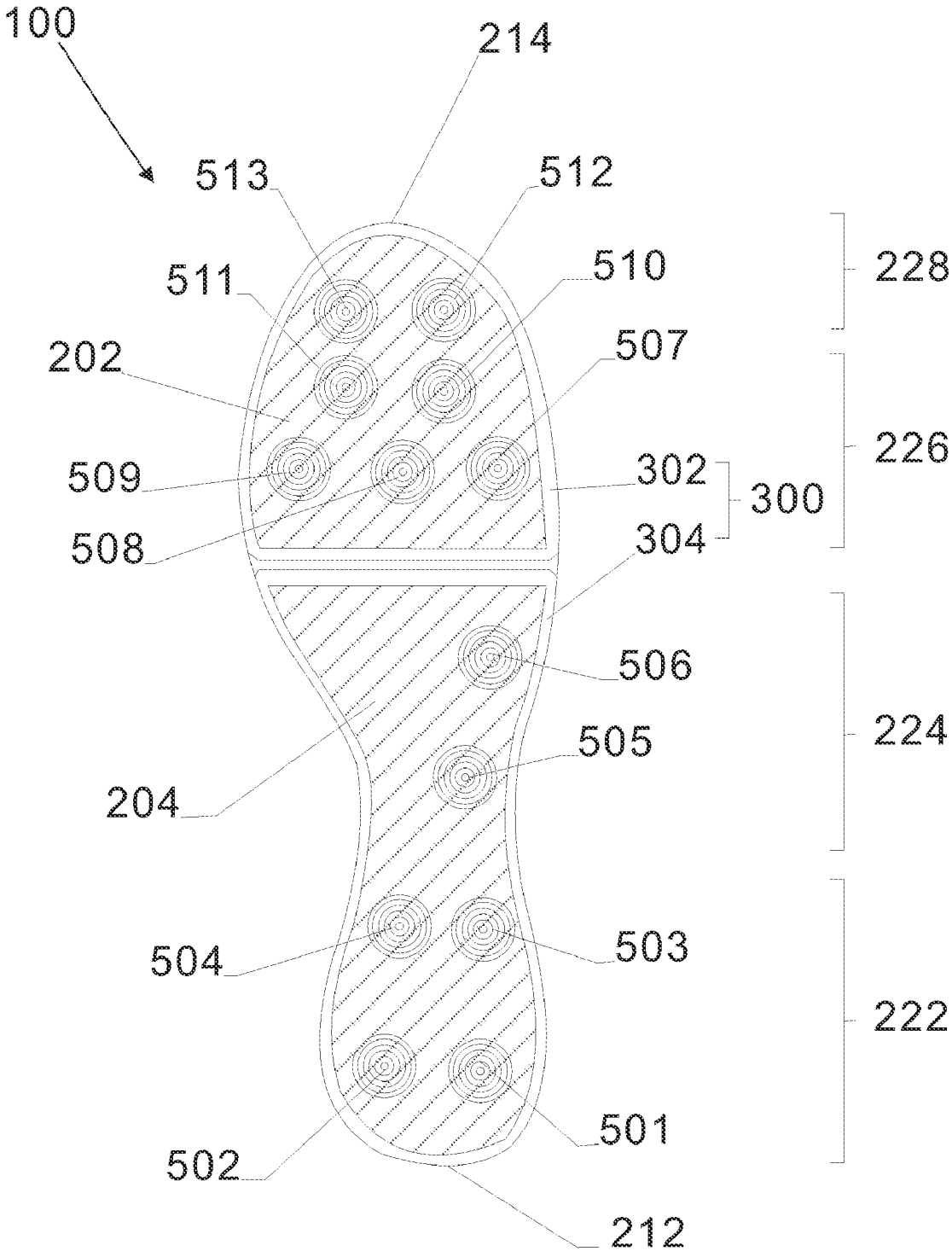
FIG. 2 is a sectional view of the footwear of FIG. 1 taken along line 2-2 of FIG. 1.

As illustrated in FIG. 2, the insole segments [202, 204] are enclosed by a front frame [302] and a back frame [304]. The frames [300] provide support to the sole assembly [200] and act as the connecting members for the foot support member [110] and other parts of the sole assembly [200] to attach to. The arrangement of the divided insole segments [202, 204] and frames [300] facilitates the bending of the insole section [210] when the user is wearing the footwear [100] for walking or running. By way of a non-limiting example, the frames [300] are made of a light metal such as aluminum.

A continuous series of compression springs [500] are arranged evenly across the sole assembly [200] from a first end [212] to a second end [214]. The sole assembly [200] may be divided into a number of portions including a heel portion [222], an arch portion [224], a ball portion [226] and a toe portion [228]. The compression springs [500] are attached to the bottom of the insole section [210]. By a non-limiting example, the insole section [210] is made of leather to form a durable surface for the compression springs [500] to attach to, which is also comfortable to the user.

As illustrated in FIG. 2, by a non-limiting example, four compression springs [501, 502, 503, 504] are disposed at the heel portion [222], two compression springs [505, 506] in the arch portion [224], five compression springs [507, 508, 509, 510, 511] in the ball portion [226] and two compression springs [512, 513] in the toe portion [228].

Such even arrangement of springs allows the user to apply force directly on the compression springs [500] at different areas of the foot. The user thus experiences a natural touch with the ground at various areas of the foot, which helps the user maintain proper balance when using the footwear [100].

By way of example, the compression springs [500] have a conical-tapered shape, which reduces the weight of the springs compared to the springs of a constant diameter. The conically tapered springs also reduce the space occupied by the compressed springs [500] in the pre-compressed and compressed positions, in particular, the height of the footwear [100] after compression. After putting on the footwear [100], the user's weight will compress the compression springs [500] and reduces the height of the footwear [100] to nearly the same height of a normal shoe.

The reduction in height of the footwear [100] and the arrangement of the compression springs [500] at various areas of the foot assist the user in gaining balance on the footwear [100]. By way of a non-limiting example, the compression springs [500] are made of materials such as carbon steel, with a height of 2 to 4 cm in the pre-compressed position, depending on the purpose and the age of the target user group.

As illustrated in FIG. 3A-3D, the insole section [210] will bend from time to time in the course of walking or running, especially when the footwear [100] is about to leave the ground. When the foot is off the ground, the insole section [210] is returned to the original flat position. As the compression springs [500] incur extra weight on the footwear [100], the user needs extra energy to return the insole section [210] to the flat position.

Figure 4:
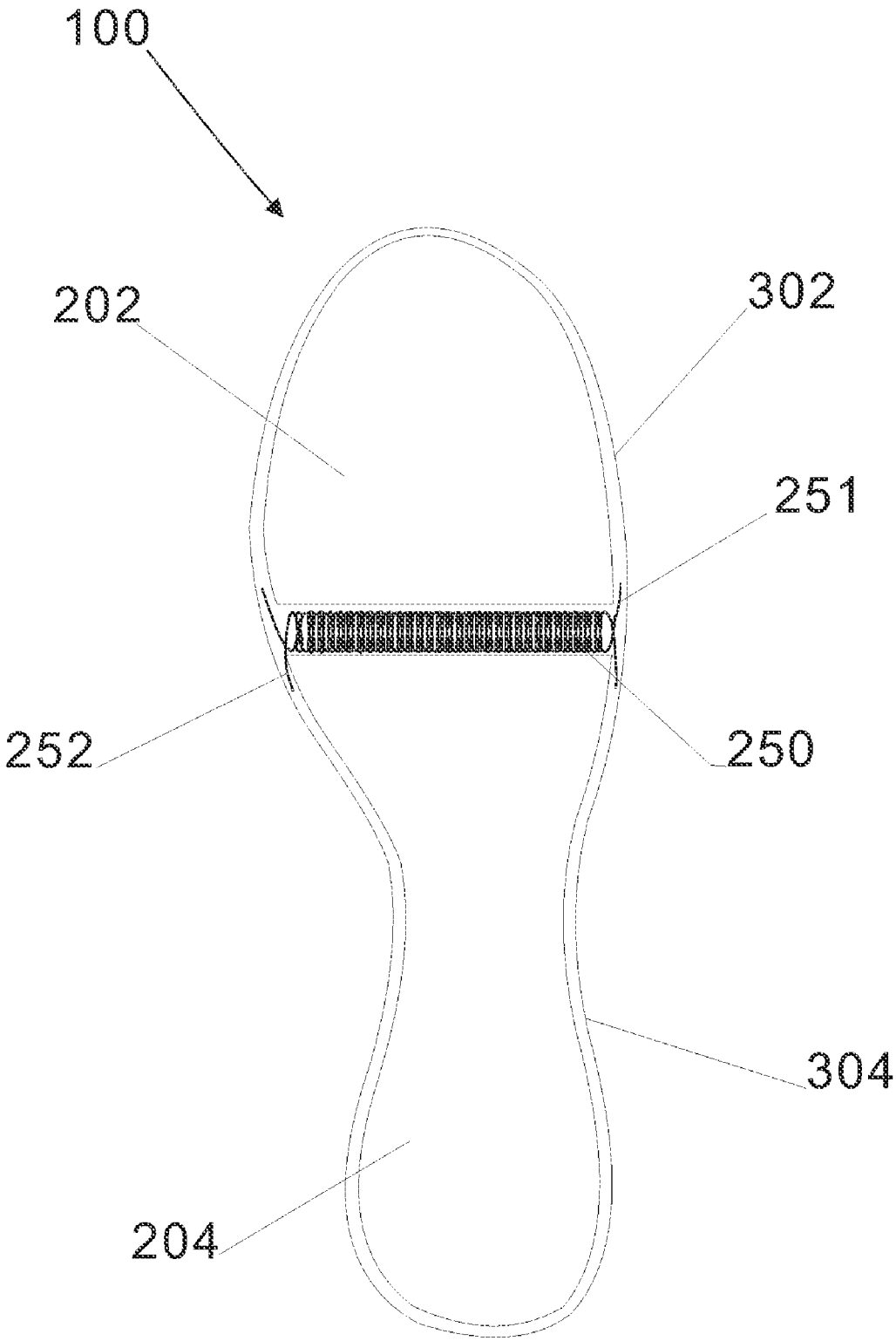
FIG. 4 is a sectional view of a sole section of the footwear of FIG. 1.

As illustrated in FIG. 4, a spring device [250] is engaged between the front insole segment [202] and the back insole segment [204] for returning the insole segments [202, 204] to the original position after bending. By way of example, the spring device [250] may include two torsion springs [250] engaged opposite to each other. Each end [251, 252] of the torsion spring [250] is attached to the opposite side of the front frame [302] and the back frame [304]. The torsion springs [250] store the energy during bending of the insole section [210] and afterwards release the energy by returning the insole section [210] to the flat position and thus save energy for the user.

Figure 3B:
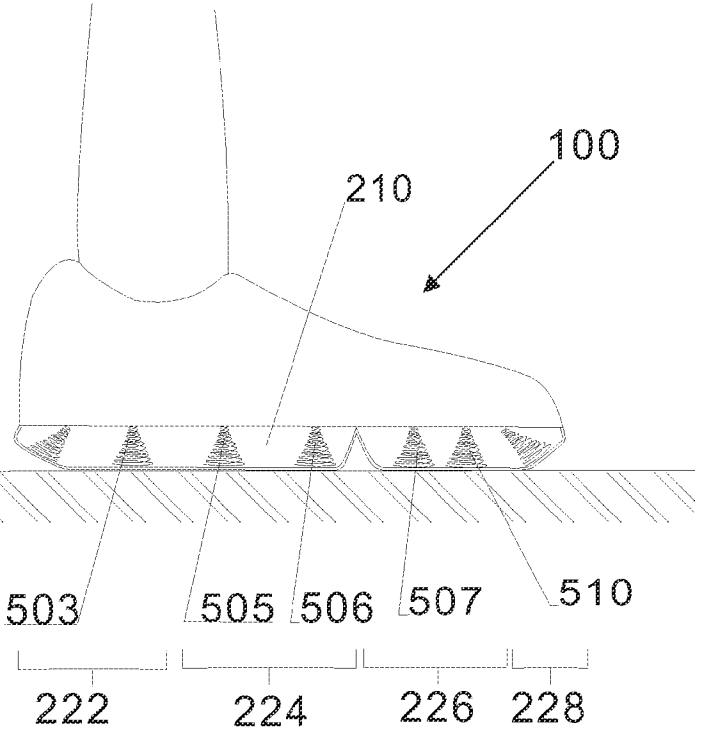
FIGS. 3A-3D illustrate the bending of and the rebounding force exerted on the footwear of FIG. 1 at various positions throughout a pace cycle.
Figure 3A:
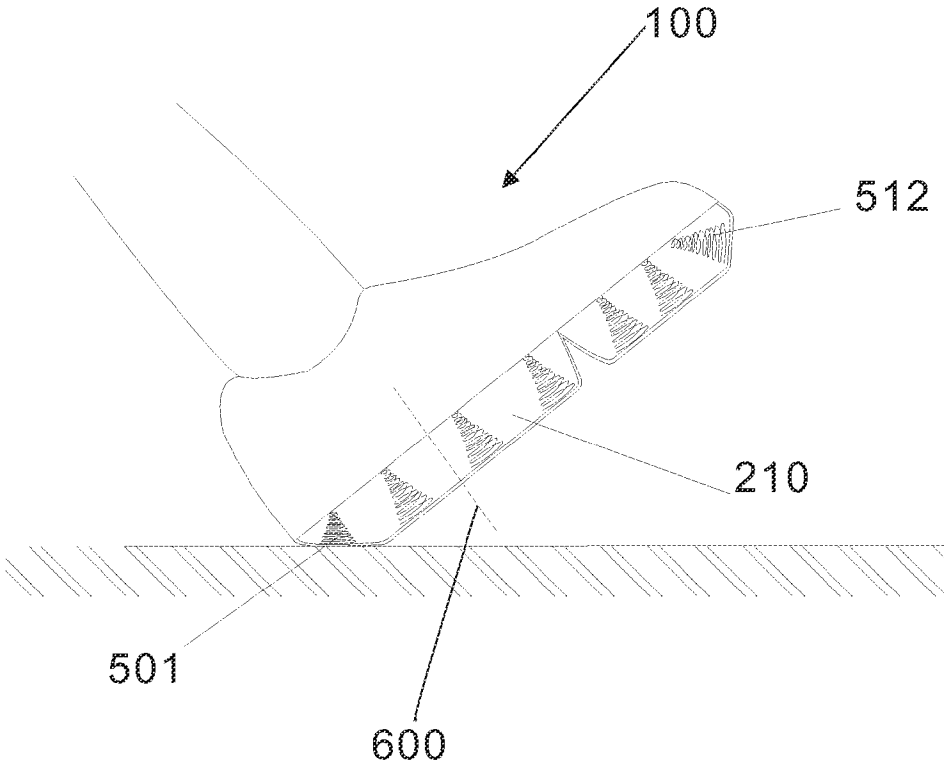

As illustrated in FIGS. 3A and 1, the compression springs [501, 502] disposed at the back of the heel portion [222] are axially tilted backward relative to a central axis of springs [600] disposed midway between the first end [212] and the second end [214] to increase the operative area at the bottom of the compression springs [501, 502] with the ground when the footwear [100] first touches the ground at the beginning of each pace cycle.

Figures 3C, 3D:
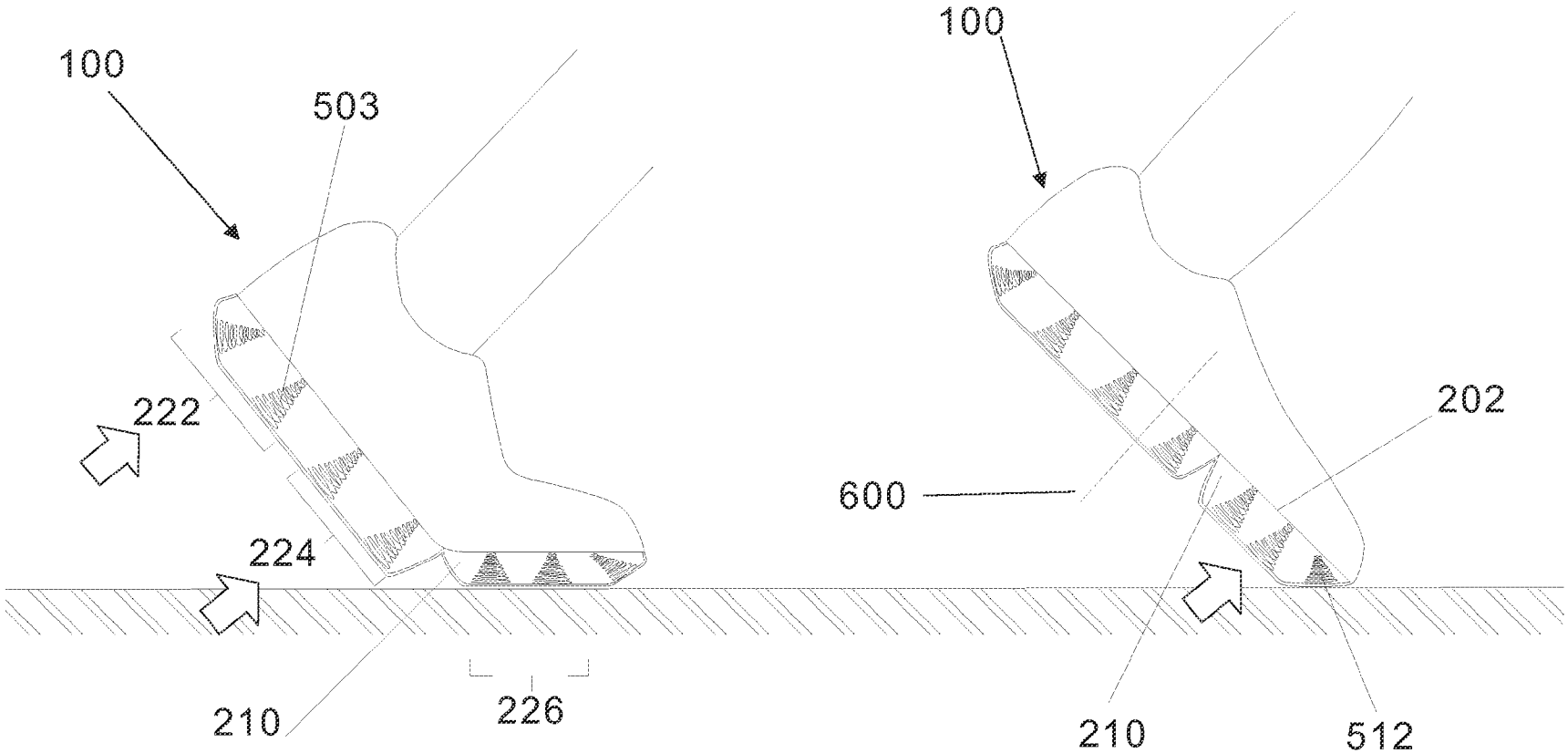

As illustrated in FIGS. 3D and 1, the compression springs [512, 513] at the toe portion [228] are axially titled forward elative to a central axis of springs [600] disposed midway between the first end [212] and the second end [214], so that the orientation of the force exerted by the release of the compression springs [512, 513] is in an upward direction to push the user forward when the toes are raised from the ground at the end of each pace cycle.

The positions of the compression springs [500] with respect to the ground at each pace cycle is illustrated in FIGS. 3A to 3D. As shown in FIG. 3A, at the beginning of each pace cycle, the back of the heel portion [222] of the sole assembly [200] first touches the ground at an angle. The weight of the user and the force applied by the foot causes the compression springs [501, 502] to be compressed.

As shown in FIGS. 3B and 1, when the foot is further laid flat on the ground, the weight is applied from the user to compress the compression springs [500] in series, from the compression springs [503, 504] of the heel portion [222] to the compression springs [505, 506] of the arch portion [224], followed by the compression springs [507, 508, 509, 510, 511] of the ball portion. At the same time, the energy saved at the compression springs [501, 502] of the heel portion [222] is released to push the heel upward, while the tilted position of the springs maximizes the energy transferred from the compression springs [501, 502] to the user. The body weight is shifting from the heel portion [222] to the arch portion [224] and the ball portion [226].

Thereafter, as shown in FIGS. 3C and 1, the foot is further bent to prepare the foot to be raised from the ground. The energy saved in the compression springs [503, 504] of the heel portion [222] applies a rebounding force to the foot, followed by the rebounding forces exerted at the arch portion [224] and the ball portion [226].

Finally, as shown in FIGS. 3D and 1, when the foot is in position to leave the ground, the compression springs [512, 513] of the toe portion [228] are compressed. At the end of the compression, a rebounding force is exerted on the toe. The orientation of the compression springs [512, 513] at the toe area is in a forward tilted position with respect to the front insole segment [202], so that the force released by the compression springs [512, 513] will be in an upward position, pushing the user forward.

The energy from the weight and the force applied by the user is therefore converted into a continuous rebounding force back to the user exerted by the compression springs [500] constantly across the sole of the user throughout a pace cycle. A similar mechanism is caused by the compression springs [500] when the user is jumping off the ground.

Figure 5:
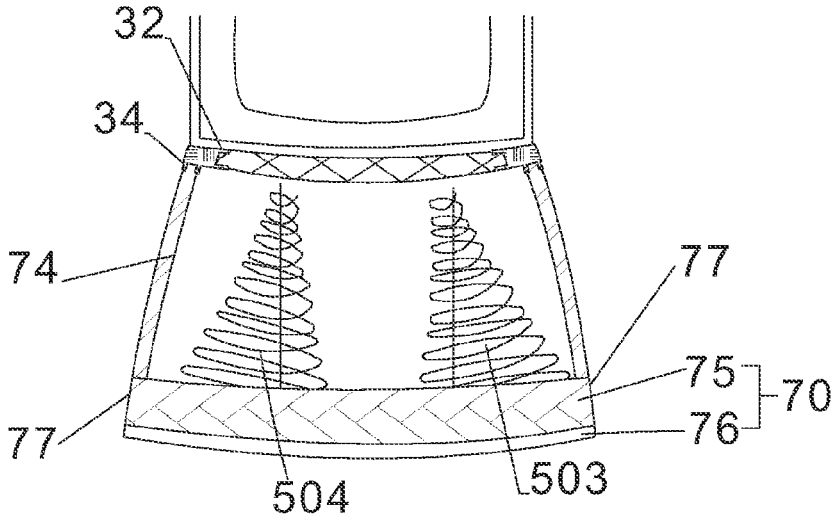
FIG. 5 is a partial sectional view of the footwear taken along line 5-5 of FIG. 1.

As illustrated in FIG. 5, an outsole portion [70] may include an upper outsole [75] and a lower outsole [76] disposed at the base of the footwear [100]. The lower outsole [76] has a gripping outer surface in contact with the ground to produce friction. The upper outsole [75] and the lower outsole [76] may be made of rubber. The outsole portion [70] is laterally wider than the insole section [210] to provide stability to the footwear [100] during the compression and expansion of the springs [500]. Such arrangement reduces the likelihood of lateral tilting of the footwear [100] and prevents an ankle sprain caused by twisting or wrenching the foot of the user.

The outsole portion [70] is slightly curved upward along the lateral width of the outsole portion [70] toward the peripheral edge [77] at the heel portion [222] and the ball portion [226] as commonly found in sports shoes. The upward curved shape increases the contact area between the lower outsole [76] and the ground. The compression springs [501, 502, 503, 504] at the heel portion [222] and the compression springs [507, 509] at the ball portion [226] are titled laterally toward the peripheral edge [77] to conform with the upwardly curved shape of the outsole portion [70]. The weight of the user is transmitted laterally toward the peripheral edge [77] of the outsole portion [70] to stabilize the user.

Figure 6:
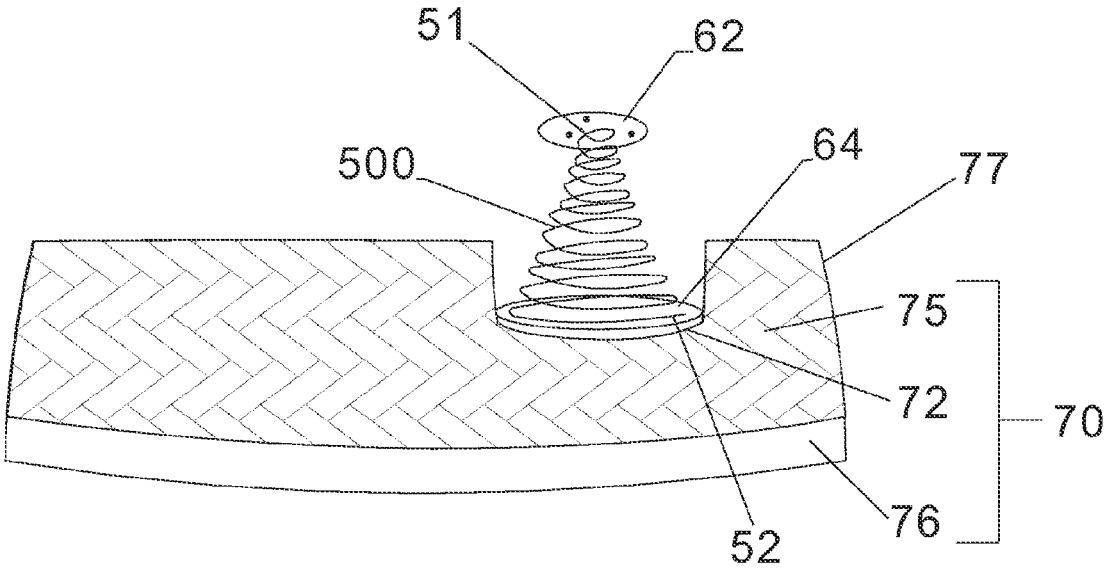
FIG. 6 is a partial sectional view of an outsole portion of the footwear taken along line 6-6 of FIG. 1.

As illustrated in FIG. 6, an indented portion [72] may be formed in the upper outsole [75] to provide a base for accommodating a lower end [52] of the compression spring [500]. The lower end [52] of the compression spring [500] is attached to a lower connecting member [64] such as a metal plate, which may be glued to the bottom of the indented portion [72]. An upper end of [51] of each compression spring [500] is attached to an upper connecting member [62] such as a metal plate, which may be grometted on the bottom of the insole section [210].

Figure 7:
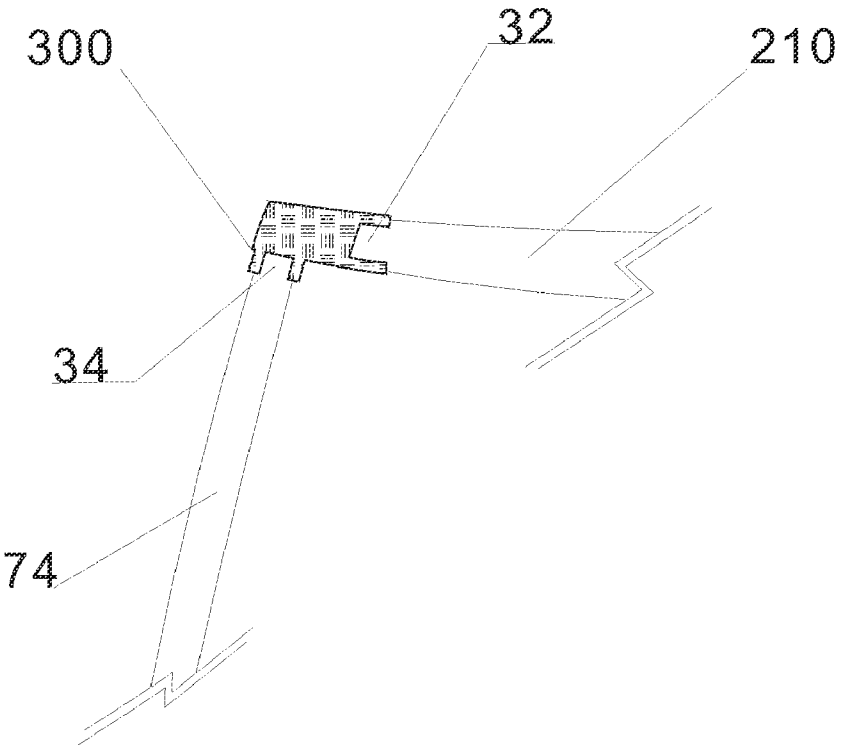
FIG. 7 is an enlarged sectional view of a frame of FIG. 1.

As illustrated in FIGS. 5 and 7, by way of example, a horizontal groove [32] is formed on the frame [300] lengthwise for receiving the insole section [210]. A vertical groove [34] is formed at the bottom of the frame [300] lengthwise and peripheral to the insole section [510] for attaching with an enclosure [74] which extends from the bottom of the frame [300] and connects with the outsole portion [70]. The enclosure [74] is made of a resilient material such as rubber and curves slightly outward in a convex shape, so that when the compression springs [500] are compressed, the enclosure [74] will be pushed outward. The enclosure [74] covers the compression springs [500] and provides a protection shield for keeping unwanted materials out of the compression springs [500] which may affect the performance of the springs.

Figure 8:
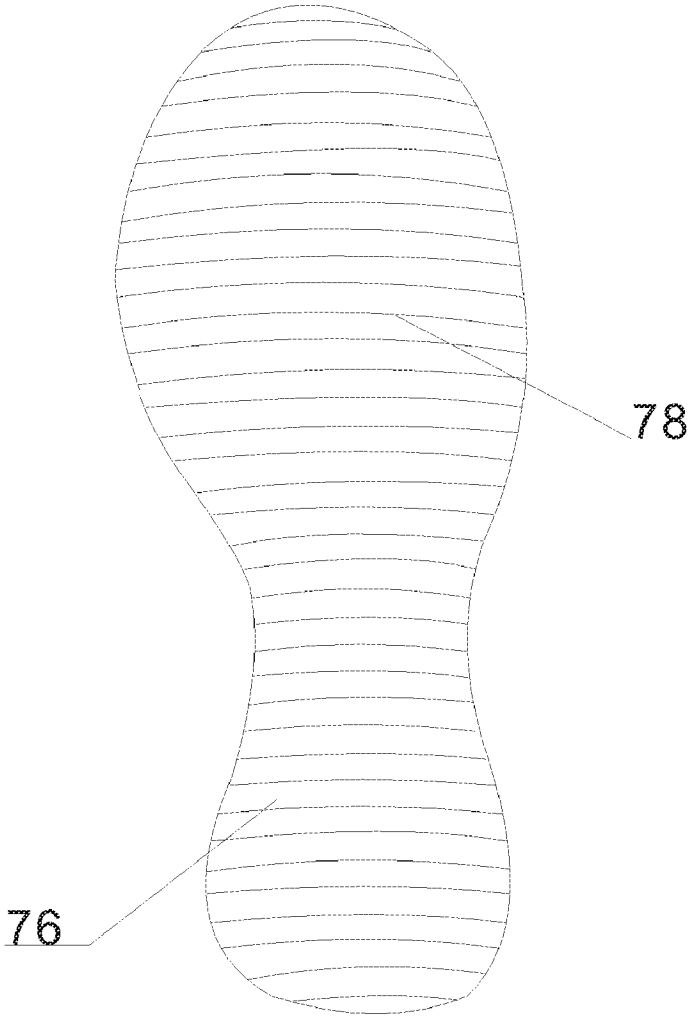
FIG. 8 is a bottom view of the footwear of FIG. 1.

The outer surface of the lower outsole [76] is impressed with multiple grooves [78] for increasing the friction between the lower outsole [76] and the ground. By way of a non-limiting example, the grooves [78] are arranged in a transverse flex pattern as illustrated in FIG. 8 to maximize the frictional force produced when the footwear [100] is engaged in a forward movement of the user.

In order for the user to maintain good balance on the shoe, the insole section [210] should not be too far above the ground. By way of a non-limiting example, the insole section [210] may be about 5 cm above the ground level in the pre-compressed position.

While the invention has been described in detail with reference to disclosed embodiments, various modifications within the scope of the invention will be apparent to those of ordinary skill in this field. It is to be appreciated that features described with respect to one embodiment typically may be applied to other embodiments.

What is claimed is:

1. Footwear including a foot support member and a sole assembly, the sole assembly having a first end and a second end, comprising:

a plurality of separate insole segments attached to the foot support member to facilitate bending of the sole assembly;

an outsole portion comprising the base of the sole assembly; and a plurality of springs engaged in a continuous series between the insole segments and the outsole portion from the first end to the second end to cause the springs to exert a constant rebounding force on and across the sole of a user throughout a pace cycle, wherein, adjacent insole segments are configured to move between an original position and a bent position, and the sole assembly further comprises a spring device disposed between adjacent insole segments for returning the insole segments from the bent position to the original position.

2. The footwear as recited in claim 1, wherein the springs are arranged evenly across the sole assembly to help the user maintain proper balance.

3. The footwear as recited in claim 1, wherein the spring device comprises at least a torsion spring.

4. The footwear as recited in claim 1, wherein the springs comprise a conically tapered shape.

5. The footwear as recited in claim 1, wherein the outsole portion is laterally wider than the insole segments to reduce the likelihood of lateral tilting of the footwear in use due to the operation of the springs.

6. The footwear as recited in claim 1, wherein the sole assembly comprises a toe portion, a ball portion, an arch portion and a heel portion, and the springs are disposed in at least one of the portions.

7. The footwear as recited in claim 6, wherein at least one of the springs disposed at the heel portion is axially tilted backward relative to a central axis of springs disposed midway between the first end and the second end to maximize the energy transferred from the spring to the user at the beginning of a pace cycle.

8. The footwear as recited in claim 6, wherein the outsole portion includes a lateral width and a peripheral edge that is slightly curved upward along the width toward the edge at the heel portion, and at least one of the springs disposed at the heel portion is axially tilted laterally toward the edge to conform with the shape of the outsole portion, whereby the weight of the user is transmitted laterally toward the edge of the outsole portion to stabilize the user when the footwear is in a flat position.

9. The footwear as recited in claim 6, wherein the outsole portion includes a lateral width and a peripheral edge that is slightly curved upward along the width toward the edge at the ball portion, and at least one of the springs disposed at the ball portion is axially tilted laterally toward the edge to conform with the shape of the outsole portion, whereby the weight of the user is transmitted laterally toward the edge of the outsole portion to stabilize the user when the footwear is in a flat position.

10. The footwear as recited in claim 6, wherein at least one of the springs disposed at the toe portion is axially tilted forward relative to a central axis of springs disposed midway between the first end and the second end, whereby an upward force is exerted by the release of the spring at the end of a pace cycle to push the user forward.

11. The footwear as recited in claim 1, wherein each sole assembly further comprises a plurality of frames for supporting the sole assembly and each frame encloses the corresponding insole segment.

12. The footwear as recited in claim 3, wherein:

each insole segment further comprises a plurality of frames for supporting the sole assembly, each frame encloses the corresponding insole segment; and the torsion spring comprises two ends, with each of the ends attached to each adjacent frame on the opposite side.

13. The footwear as recited in claim 1, wherein the sole assembly further comprises an enclosure of a resilient material disposed peripheral to the sole assembly to shield the springs.

14. The footwear as recited in claim 11, wherein the sole assembly further comprises an enclosure of a resilient material attached peripheral to the sole assembly to shield the springs, wherein the enclosure is disposed between the frames and the outsole portion.

15. The footwear as recited in claim 1, wherein the outsole portion further comprises a plurality of indented portions for receiving the corresponding springs.

16. The footwear as recited in claim 1, wherein the spring includes an upper end and further comprising an upper connecting member attached to the upper end and a bottom part of the corresponding insole segment.

17. The footwear as recited in claim 15, wherein the spring includes a lower end and further comprising a lower connecting member attached to the lower end and the outsole portion in the corresponding indented portion.

18. The footwear as recited in claim 1, wherein the sole assembly comprises a toe portion, a ball portion, an arch portion and a heel portion, and at least one of the springs is disposed at each portion.

19. A sole assembly of a shoe, the sole assembly comprising:

more than one insole segment rotatably attached to an adjacent insole segment;

a spring device disposed between each adjacent insole segment to bias each insole segment in a parallel position relative to the adjacent insole segment;

an outsole portion with a first end and a second end, the outsole portion comprising the base of the sole assembly; and a plurality of springs engaged in a continuous series between the insole segments and the outsole portion from the first end to the second end to cause the springs to exert a constant rebounding force on and across the sole of a user throughout a pace cycle, wherein springs proximate to the first end of the outsole portion are axially tilted backward relative to a central axis of springs disposed midway between the first end and the second end and springs proximate to the second end of the outsole portion are axially tilted forward relative to a central axis of springs disposed midway between the first end and the second end.

20. Footwear to be worn by a user, the footwear comprising:

a foot support member;

a sole assembly comprising a plurality of insole segments attached to the foot support member to facilitate bending of the sole assembly wherein the insole segments are configured to move between an original position and a bent position;

a spring device disposed between adjacent insole segments to return the insole segments from the bent position to the original position;

an outsole portion; and a plurality of springs engaged in a continuous series between the insole segments and the outsole portion from a first end to a second end of the sole assembly to cause the springs to exert a constant rebounding force on a sole of the user throughout a pace cycle.

* * * * *